United States Patent [19]

Akashi

[11] 4,232,431

[45] Nov. 11, 1980

[54] SLIDE FASTENER

[75] Inventor: Shunji Akashi, Kurobe, Japan

[73] Assignee: Yoshida Kogyo K.K., Tokyo, Japan

[21] Appl. No.: 27,097

[22] Filed: Apr. 4, 1979

[30] Foreign Application Priority Data

Apr. 20, 1978 [JP] Japan ..... 53/52455[U]

[51] Int. Cl.[2] ..... A44B 19/36

[52] U.S. Cl. ..... 24/205.11 R; 24/205.13 C; 24/205.11 F

[58] Field of Search ..... 24/205.11 R, 205.11 F, 24/205.13 C

[56] References Cited

U.S. PATENT DOCUMENTS

| | | | |
|---|---|---|---|
| 2,332,923 | 10/1943 | Lohse | 24/205.11 R |
| 3,086,269 | 4/1963 | Taylor | 24/205.11 R |
| 3,309,746 | 3/1967 | Carlile | 24/205.11 R |
| 3,905,073 | 9/1975 | Fukurdi | 24/205.11 R |
| 3,906,594 | 9/1975 | Tarahashi et al. | 24/205.11 F |
| 3,951,715 | 4/1976 | Hofius | 24/205.11 F X |
| 4,045,845 | 9/1977 | Kando | 24/205.11 F |
| 4,155,147 | 5/1979 | Akashi | 24/205.11 F |

FOREIGN PATENT DOCUMENTS

| | | | |
|---|---|---|---|
| 599440 | 7/1973 | Switzerland | 24/205.11 F |

*Primary Examiner*—Roy D. Frazier
*Assistant Examiner*—Peter A. Aschenbrenner
*Attorney, Agent, or Firm*—Robert E. Burns; Emmanuel J. Lobato; Bruce L. Adams

[57] ABSTRACT

An open end slide fastener comprises a pair of stringer tapes each carrying along one longitudinal edge a row of coupling elements and a pair of end stop lugs, each of the coupling elements including a pair of spaced legs and a coupling head extending therebetween. The coupling head has a pair of lateral projections extending longitudinally of the row of coupling elements beyond the width of the legs. The interengaged lateral projections of the coupling heads of the opposed endmost coupling elements located next to the top end stop lugs are cut off to permit the endmost coupling elements to be disengaged from each other when the fastener is closed. The legs of one endmost coupling element are partly cut off to define a slot extending transversely of the rows of coupling elements, permitting the endmost coupling elements to move unobstructedly toward and away from each other.

5 Claims, 5 Drawing Figures

SLIDE FASTENER

BACKGROUND OF THE INVENTION

1. Field of the Invention

This invention relates to a slide fastener and more particularly to an open end slide fastener having a separably top end stop.

2. Prior Art

There have been proposed many open end slide fasteners. A common drawback of such fastener is that when the fastener is fully closed, the opposed fastener tapes tend to flare up at their respective upper ends owing to a guide post or diamond portion of a slider which urges the tape ends apart and makes them pucker on each side of the slider. As a result, it becomes difficult to sew fastener having such flared and waved tape ends neatly onto a garment or the like.

An improvement has been made in the art such that an open end slide fastener can be held in closed disposition with respective tape ends aligned and straightened by providing a top end stop including a pair of lugs of which opposed inner edges form therebetween a substantially V-shaped opening for receiving the diamond portion of the slider when the fastener is fully closed. While this prior fastener device has accomplished the purpose of preventing the tape ends from getting spread apart or flared up, it has encountered a different drawback described below. The lugs of top end stop respectively secured to the tapes adjacent to or substantially integral with the endmost coupling elements are liable to hinder the smooth engagement or disengagement of the endmost coupling elements, when the slider moves past them in the fastener opening or closing direction. The slider tends to be stopped at a position just before the top end stop when the fastener is to be closed, letting the opposed fastener tapes flare up at their respective ends. The starting movement of the slider in the fastener opening direction is also prone to become sluggish, sometimes even impossible. Where the top end stop and the coupling elements are made of plastic material, the endmost coupling elements are subjected to deformation under heat and pressure during the integral formation of the top end stop with the endmost coupling elements. In this case, the foregoing problem becomes much worse.

SUMMARY OF THE INVENTION

Accordingly, an object of this invention is to provide a slide fastener having a slider smoothly slidable in its movement toward and from the top end stop.

According to the invention, interengaged lateral projections of the coupling heads of opposed endmost coupling elements located next to a pair of top end stop lugs are cut off to permit the endmost coupling elements to be disengaged from each other when the slide fastener is closed. One of the endmost coupling elements has legs being partly cut off to define a slot extending transversely of the rows of coupling elements.

These and other object and features of the invention will be more apparent from the following detailed description taken with reference to the accompanying drawings which illustrate by way of example a certain preferred embodiment which the invention may assume in practice.

DETAILED DESCRIPTION OF THE PREFERRED EMBODIMENT

Figure 1:
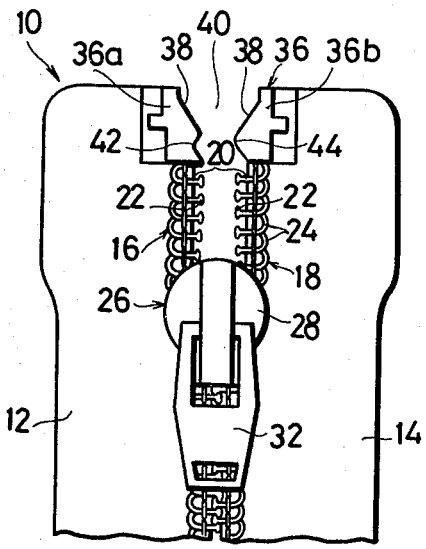
FIG. 1 is a fragmentary plan view of a slide fastener with its top end separated.
Figure 2:
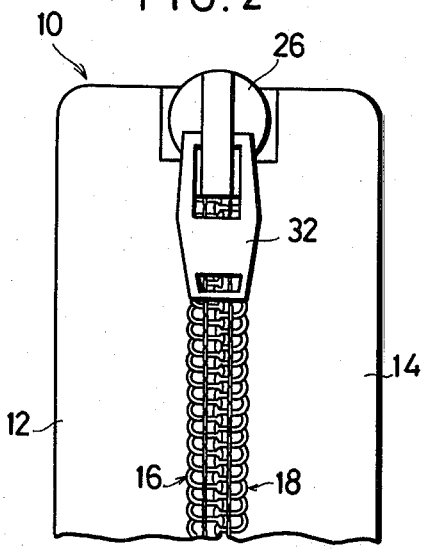
FIG. 2 is a view similar to FIG. 1 but showing the fastener in fully closed condition.

Referring to the drawings and FIG. 1 in particular, there is shown a fragment of a slide fastener generally designated 10 which comprises a pair of stringer tapes 12,14 each carrying on and along its inner longitudinal edge a row of coupling elements 16,18 formed from a continuous plastic filament into a helical coil structure including a plurality of turns spaced longitudinally of the tape. Each of the turns includes a pair of spaced legs 20 (only upper one shown) between which the inner edge of the tape 12,14 extends, and a coupling head 22 extending between said legs 20, the coupling head 22 having a pair of lateral projections 23 extending longitudinally of the row of coupling elements 16,18 beyond the width of the legs 20 so that the rows of coupling elements can be interlocked together by interengagement of the lateral projections of opposed coupling heads. Each coupling element 16,18 further has a plurality of connecting portions 24 each extending between adjacent two of the legs 20.

The opposed rows of coupling elements 16,18 are taken into and out of mutual engagement by a slider 26 to open and close the fastener 10 in a well known manner. The slider 26 comprises a body 28, a pair of flanges 30 extending downwardly from opposite sides of the body 28, a pull tab 32 pivotally connected to the body for manipulating the slider 26 and a guide post or diamond portion 34 projecting intermediate the side flanges 30 to define therebetween a substantially Y-shaped guide channel for the passage therethrough of the rows of coupling elements 16,18. The form and construction of the slider 26 is conventional and here will require no further description.

A top end stop 36 comprises a pair of lugs **36*a*,36*b* formed from thermoplastic material and secured to respective inner longitudinal edges of the stringer tapes 12,14. The top end stop lugs 36*a*,36*b* are fused preferably together with extensions of the tape edges so that they can be retained firmly in place against displacement when subjected to external forces. An inner edge 38 of each of the top end stop lugs 36*a*,36*b* is cut together with the tape fabric obliquely to extend divergently with respect to the longitudinal axis of the fastener, so that when the two opposed lugs 36*a*,36*b* are brought toward each other, they define therebetween a substantially V-shaped bay or opening 40 complementary in shape with the contour of the diamond 34 of the slider 26, the V-shaped opening 40 thus serving to receive and anchor the diamond 34 therein when the slider 26 has taken the fastener into fully closed position as better shown in FIG. 3**.

The inner oblique edge 38 of the top end stop lug 36*a* terminates in a recess 42 and that of mating lug 36*b* extends a short distance to form a first projection 44 direction toward the recess 42. Contiguous to the recess 42 of the end stop lug 36*a* is a second projection 46 extending complementarily with the downward slope of the first projection 44 and terminating in the lower edge of the end stop lug 36*a*. At least one of the projections 44,46 extends transversely beyond a central longitudinal axis C of the rows of coupling elements 16,18 that are interengaged. Each of the top end stop lugs 36*a*,36*b* has a shoulder 48 extending horizontally for abutting engagement with one of the upper ends of the respective flanges 30 of the slider 26 when the latter is in the upper most position shown in FIG. 3.

In accordance with the invention, a pair of endmost coupling elements $E_1$,$E_2$ (FIG. 3) are fused integrally with the top end stop 36 in such a manner that the first endmost coupling element $E_1$ joined at its connecting portion 24 to the lower edge of the end stop lug 36*b* and the second endmost coupling element $E_2$ is joined at its legs 20 to the lower edge of the top end stop lug 36*a*. The interengaged lateral projections of the coupling heads 22 of the opposed endmost coupling elements $E_1$,$E_2$ located next to the top end stop lugs 36*a*,36*b* are cut off to form flattened coupling surfaces 50, thereby permitting the endmost coupling elements $E_1$,$E_2$ to be disengaged from each other when the slide fastener 10 is closed. The legs 20 of the endmost coupling element $E_2$ are partly cut off to form a cut-off flattened surface 52, thereby defining a slot S extending transversely of the rows of coupling elements $E_1$,$E_2$. The slot S preferably has a length larger than the distance between the interengaged coupling heads.

For the formation of the top end stop 36 and the slotted endmost coupling elements $E_1$,$E_2$ just described above, a strip of thermoplastic material (not shown) is placed on one surface of the tapes, the strip overlying a group of the coupling elements 16,18. Then heat and pressure is applied by the anvil of suitable ultrasonic welding or high-frequency heating means (not shown) to the strip for simultaneously fusing the strip with the stringer tapes 12,14 and the group of coupling elements 16,18 and shaping the top end stop 36. Simultaneously with the formation of the end stop 36, the slot S is also formed in the endmost coupling elements $E_1$,$E_2$. The V-shaped opening 40, the recess 42, projections 44,46 and slot S are formed at the same time by a correspondingly shaped punch (not shown) on the anvil, such that the slot S communicates with the V-shaped opening 40 through the recess 42 receiving the projection 44.

Figure 3:
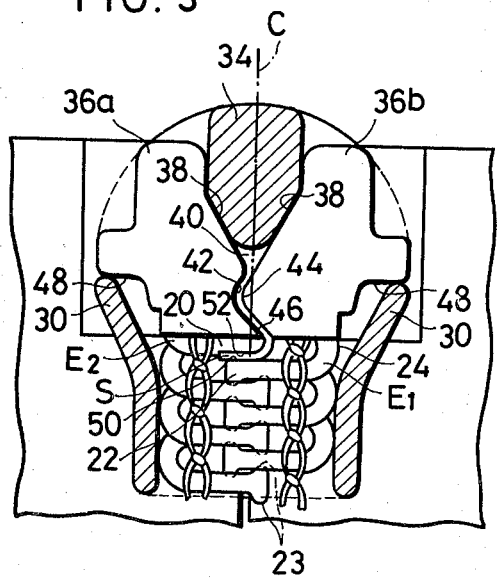
FIG. 3 is an enlarged fragmentary plan view of closed top end portion of the fastener with the top slider body cut away to show the relative positions of the slider diamond, top end stop and endmost coupling elements provided according to the invention.
Figure 4:
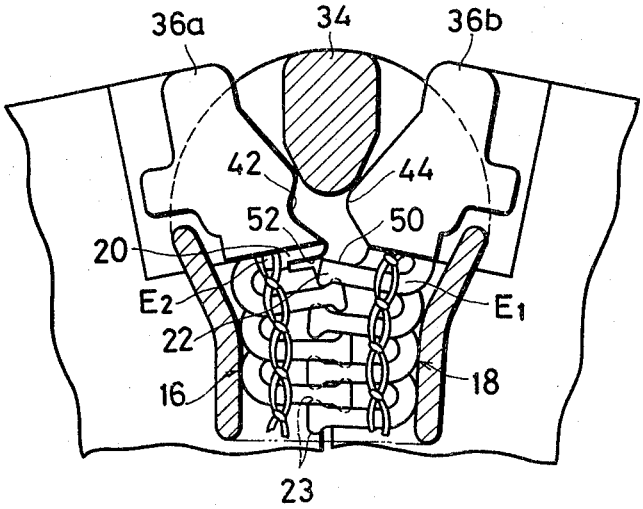
FIGS. 4 and 5 are enlarged fragmentary plan views of the fastener respectively showing progressive movement of the slider in the fastener opening direction from the top end portion of the fastener.
Figure 5:
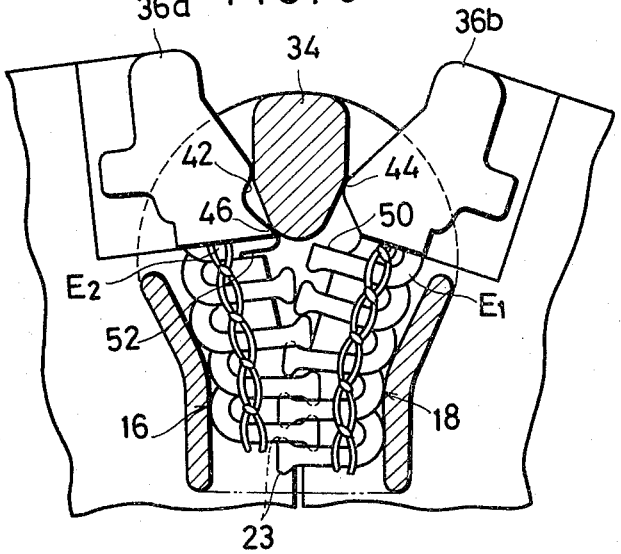

In FIGS. 4 and 5, when the slider 26 starts moving in the fastener opening direction from the position of FIG. 3, the diamond 34 of the slider 26 is brought into abutting engagement with the first projection 44 of the lug 36*b* and urges the two opposed top end stop lugs 36*a*,36*b* to spread apart, whereupon the pair of endmost coupling elements $E_1$,$E_2$ begin to move apart from each other, as shown in FIG. 4. At this time, the slot S permits the endmost coupling elements $E_1$,$E_2$ to start moving unobstructedly away from each other.

As the slider 26 further advances in the fastener opening direction, the diamond 34, while being still engaged with the first projection 44 of the top end stop lug 36*b*, now impinges upon the second projection 46 of the top end stop lug 36*a* and continues to force apart the opposed top end stop lugs 36*a*,36*b*, thereby urging further apart the endmost coupling elements $E_1$,$E_2$, as shown in FIG. 5.

The fastener closing operation can be accomplished by reversing the above-mentioned fastener opening operation. As the slider moves from the position shown in FIG. 5 to that of FIG. 3, the flattened coupling surface 50 of the first endmost coupling element $E_1$ moves without interferential contact with the cut-off flattened surface 52 of the second endmost coupling element $E_2$, thereby allowing the slider 26 to be brought smoothly into the position shown in FIG. 3.

Various changes and modifications may be made in the precise form and construction of the open end slide fastener herein shown and described, without departing from the scope of the appended claims.

What is claimed is:

1. An open end slide fastener comprising a pair of stringer tapes each carrying a row of coupling elements along one longitudinal edge, each of said coupling elements including a pair of spaced legs supported on one of said tapes and a coupling head extending between said legs, said coupling head having a pair of lateral projections extending longitudinally of the row of coupling elements beyond the width of the legs so that the rows of coupling elements can be interlocked together by interengagement of said lateral projections of the opposed coupling heads, a slider having a diamond and adapted to open and close the fastener, and a top end stop including a pair of lugs secured to the longitudinal edges of the respective stringer tapes, said lugs having oblique opposed edges extending divergently with respect to the longitudinal axis of the fastener and jointly defining therebetween a substantially V-shaped opening complementary in shape with the diamond of the slider, said interengaged lateral projections of the coupling heads of the opposed endmost coupling elements located next to said top end stop lugs being cut off to permit said endmost coupling elements to be desengaged from each other when the slide fastener is closed.

2. An open end slide fastener according to claim 1, the legs of at least one of said endmost coupling elements being partly cut off to define a slot extending transversely of the rows of coupling elements.

3. An open end slide fastener according to claim 2, said slot having a length larger than the distance between the interengaged coupling heads.

4. An open end slide fastener according to claim 2, one of said lugs having at least one projection contiguous to said oblique inner edge, the other lug having at least one recess receptive of said projection, said projection extending transversely of the rows of coupling elements and disposed for abutting engagement with said diamond of the slider when the slider moves past said top end stop for opening the slide fastener, and said slot communicating with said V-shaped opening through said recess receiving said projection.

5. An open end slide fastener according to claim 1, said top end stop lugs and said coupling elements being made of plastic material, and said top end stop lugs being integral with said endmost coupling elements.

* * * * *